US005095583A

United States Patent [19]

Prevot

[11] Patent Number: 5,095,583

[45] Date of Patent: Mar. 17, 1992

[54] FOLDING-ARM BEARING FOR AN OSCILLATING-SWINGING LEAF

[75] Inventor: Gérard Prevot, Willerwald, France

[73] Assignee: Ferco International Usine de Ferrures de Batiment, Sarresbourg, France

[21] Appl. No.: 584,719

[22] Filed: Sep. 19, 1990

[30] Foreign Application Priority Data

Oct. 2, 1989 [FR] France ..... 89 13010

[51] Int. Cl.[5] ..... E05D 7/04; E05D 5/00; E05D 15/22

[52] U.S. Cl. ..... 16/243; 16/270; 16/382; 16/388; 49/188; 49/385

[58] Field of Search ..... 16/235, 236, 238, 240–246, 16/254, 260–266, 270–272, 360, 362, 366, 367, 387, 389, 382, 383, 384; 49/188–195, 149, 381–385

[56] References Cited

U.S. PATENT DOCUMENTS

| | | | |
|---|---|---|---|
| 880,317 | 2/1908 | Marwitz | 16/388 |
| 2,683,279 | 7/1954 | Okerlund et al. | 16/245 |
| 3,030,655 | 4/1962 | Rudnick | 16/243 |
| 3,104,428 | 9/1963 | Benham | 16/235 |
| 3,867,790 | 2/1975 | Frank | 16/360 |
| 4,785,498 | 11/1988 | Brotschi | 16/240 |
| 4,980,946 | 1/1991 | Versani et al. | 16/235 |

FOREIGN PATENT DOCUMENTS

| | | |
|---|---|---|
| 3702957 | 5/1988 | Fed. Rep. of Germany . |
| 2295207 | 7/1976 | France . |
| 2423611 | 11/1979 | France . |
| 2563564 | 10/1985 | France . |

*Primary Examiner*—Lowell A. Larson
*Assistant Examiner*—Thomas C. Schoeffler
*Attorney, Agent, or Firm*—Sandler, Greenblum & Bernstein

[57] ABSTRACT

Folding-arm bearing for an oscillating-swinging leaf of doors, windows or the like, comprises a support inserted on the sash-frame and a square-shaped blade having a wing onto which is pivotally mounted a plate bearing a folding-arm leg by a connector. In order to facilitate the reversibility of this folding-arm bearing without disassembling of components, the wing of the blade is provided, on its upper and lower edges, with a pin engaging into an opening made in the connector, and the plate is mounted onto this wing by means of an eccentric having a rotation which generates a vertical movement of the plate causing the disengagement of a pin from the opening present in the connector.

14 Claims, 1 Drawing Sheet

FOLDING-ARM BEARING FOR AN OSCILLATING-SWINGING LEAF

BACKGROUND OF THE INVENTION

1. Field of the Invention

The invention relates to a folding-arm bearing for an oscillating-swinging leaf of doors, windows or the like, comprising a support inserted onto the internal face of the sash-frame and a blade pivotingly mounted onto the support and having the shape of a square so as to define a wing which, in closing position of the door, window or the like, engages into the fillister of the sash-frame. On the rear face of this wing being pivotingly and movably mounted a plate at the free end of which is fastened a folding-arm leg by means of a connector. This invention more particularly relates to the specialist industry of building ironmongery.

2. Discussion of Background and Material Information

There are already known a number of folding-arm bearings for ensuring the upper connection of a leaf to a sash-frame namely of an oscillating-swinging-type door, window or the like. Very generally, these folding-arm bearings are distinguishable from each other in function, either by their way of fastening onto the sash-frame or by the nature of the material the sash-frame is made of, or even by the size and the weight of the leaf of the door, window or the like. These folding-arm bearings very often comprise a support composed of a fastening plate for being inserted onto the sash-frame, and two knuckles arranged in a same vertical alignment on the fastening plate, and into which is engaged a pin. They are furthermore provided with a blade provided with a bushing pivotingly mounted onto the aforementioned pin, while engaging between both knuckles of the support. The configuration of this blade is generally determined so that it be capable of engaging into the fillister of the door or window and of co-operating with a folding-arm leg connected to the leaf.

It should be appreciated that this connection between the blade and the folding-arm leg can be in various ways.

Thus, in a first case, this blade can be provided with a pivot consisting in a casing comprising a substantially horizontal axis bore located in the extension of the folding-arm leg. Into this bore is engaged the cylindrical rear end of the folding-arm leg for being fastened in same by appropriate means. By way of example, such means can be in the form of an external thread provided at the cylindrical end of the folding-arm leg, which external thread co-operates with a nut or equivalent located beyond the pivot. It should be appreciated that such an arrangement enables the adjustment of the position of the leaf with respect to its sash-frame in its upper part.

There also exist other solutions for ensuring this connection between the blade of the folding-arm bearing and the folding-arm leg. Thus, the blade may take the form of a square so as to have a wing which is capable of engaging, in closing position of the door or window, into the fillister on this wing is inserted, by screwing-in or the like, the bent end of the folding-arm leg.

The present concern of the specialist industrialists in the field of building ironmongery generally consists in standardizing their manufacturing so as to reduce the cost of the various parts while providing a solution for the problem of storage.

It is namely convenient to confer to the various components of a hinge the necessary characteristics for same to be reversible, thus allowing their implementation indifferently onto right-hand and left-hand doors or windows.

Within the framework of the association of the blade with the folding-arm leg, this reversibility is in connection with the symmetrical structure of the blade and the possible separation of the blade from the folding-arm leg. Thus, it is possible to supply the carpenter who ensures the mounting of these hinges onto doors or windows with a set of loose parts. This carpenter should afterwards ensure the assembling and positioning of the various parts with respect to each other depending on the right-hand or left-hand implementation of the hinge on a door or window.

Consequently, this solution of supplying the carpenter with loose parts seems to be disadvantageous, since this requires an increased time for fitting these hinges and multiplies the nature of the parts kept in stock. Another solution consists in supplying this carpenter with pre-assembled hinges for a determined use of same, either right-hand or left-hand, on a door or window. This solution, without being prejudicial to the conditions of storage with the manufacturer, only partly solves the problem of the time required by the carpenter for mounting and assembling these hinges. However, it is obvious that, in order to allow, for instance, the left-hand use of these hinges initially intended for a right-hand application, this carpenter will be obliged to previously disassemble them to change the arrangement of the parts with respect to each other.

All things considered, this solution does not allow to conciliate the problems of storage for the manufacturer, and the requirements related to the time of mounting for the carpenter.

On the other hand, there is known a reversible folding-arm bearing comprising, a support fastened onto the sash-frame and, a blade pivotally mounted onto this support, and having the form of a square so as to define a wing capable of engaging, in closing position of the door, window or the like, into the fillister of the leaf and sash-frame. More particularly, onto the rear face of this wing, and substantially in its horizontal median plane, is pivotally mounted a plate having a free end which receives a pivot receiving the rear end of the folding-arm leg.

The locking in rotation of the plate with respect to the wing arranged in the fillister corresponding to the blade is achieved by means of a screw passing through the plate and co-operating with a tapped hole made at the level of the wing. In fact, this latter is provided, on both sides of its horizontal median plane, with such a tapped hole enabling it to receive the locking screw corresponding to the plate. The whole leading to a reversible folding-arm bearing.

It should be appreciated that the locking by screwing of the plate with respect to the blade is in no way capable of meeting user's requirements, and namely those of the carpenter who will have to affix this folding-arm bearing onto his carpentry works.

The screwing-on is a particularly time-taking operation and has the disadvantage of requiring a reduced-size screw, the handling of which is difficult and which can easily be lost.

To these problems is to be added the one arising from the tooling the carpenter requires when fitting and adjusting the set of hinges that the leaf or sash-frame of a door, window or the like is fitted with. It should indeed be stated that this tooling should be reduced to a very minimum, and preferably to one single tool so that the time which should be assigned to this fitting and adjusting of the components of a hinge can be reduced as much as possible.

Now, in most cases, the mounting and removing of the various components of a folding-arm bearing require the use of a tool or several tools differing from those intended for adjusting or mounting other components of a hinge that the door, window or the like is fitted with.

SUMMARY OF THE INVENTION

The object of this invention is to cope with all the above-mentioned troubles by providing a folding-arm bearing having a reversibility which is not related to the disassembling followed by a re-assembling of the components of which it is composed, but to a simple adjustment carried out by means of a standard tool which will be used during the various mounting and adjusting operations for the other components of a hinge of the door, window or the like.

The invention solves the problem by providing a folding-arm bearing for an oscillating-swinging leaf of doors, windows or the like, which comprises a support inserted onto the internal face of the sash-frame and a blade pivotingly mounted onto the support and having the shape of a square so as to define a wing which, in closing position of the door, window or the like, engages into the fillister on the rear face of this wing is pivotally and movably mounted a plate at the free end of which is fastened a folding-arm leg by means of a connector. The wing corresponding to the blade is provided on its upper and its lower edge with a pin capable of engaging into an opening made at the level of the lower face of the casing forming the connector, the plate is pivotally and movably mounted the rear face of the wing corresponding to the blade by rotating means comprised of an eccentric having a rotation which generates a vertical movement of the plate with respect to the blade to cause the disengagement of a pin from the opening present in the connector.

The advantages obtained by this invention mainly consist in that the folding-arm bearing both solves the problem of standardization of the components at the level of the manufacturing and meets the requirements of fitting for the carpenter. More particularly, the manufacturer is able to produce and store a folding-arm bearing intended for a determined use without the modifying of this folding-arm bearing with a view to another use causing a loss of time for the carpenter or requiring a specific tool.

BRIEF DESCRIPTION OF THE DRAWINGS

This invention will be better understood with reference to the attached drawings.

DETAILED DESCRIPTION OF THE PREFERRED EMBODIMENTS

Figure 1:
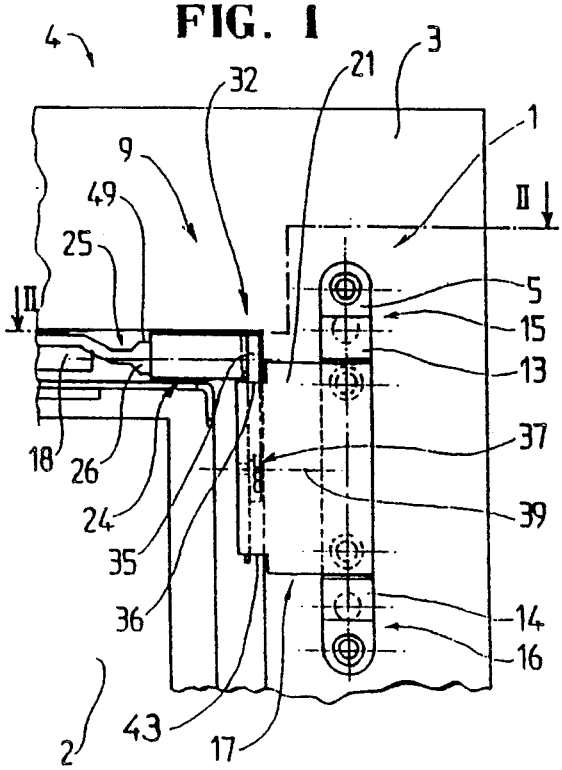
FIG. 1 is an elevational view of the folding-arm bearing according to the invention.
Figure 2:
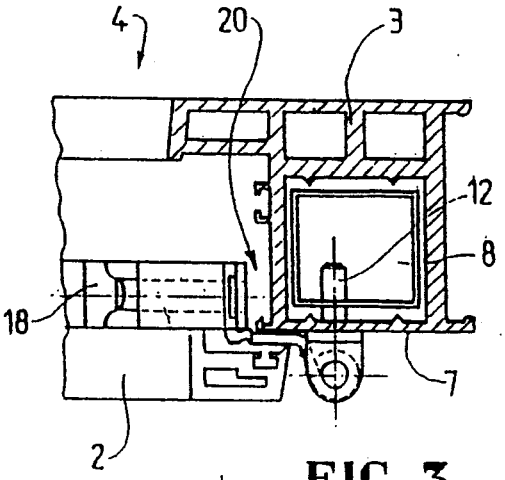
FIG. 2 is a cross-sectional view taken along II—II of FIG. 1.
Figure 3:
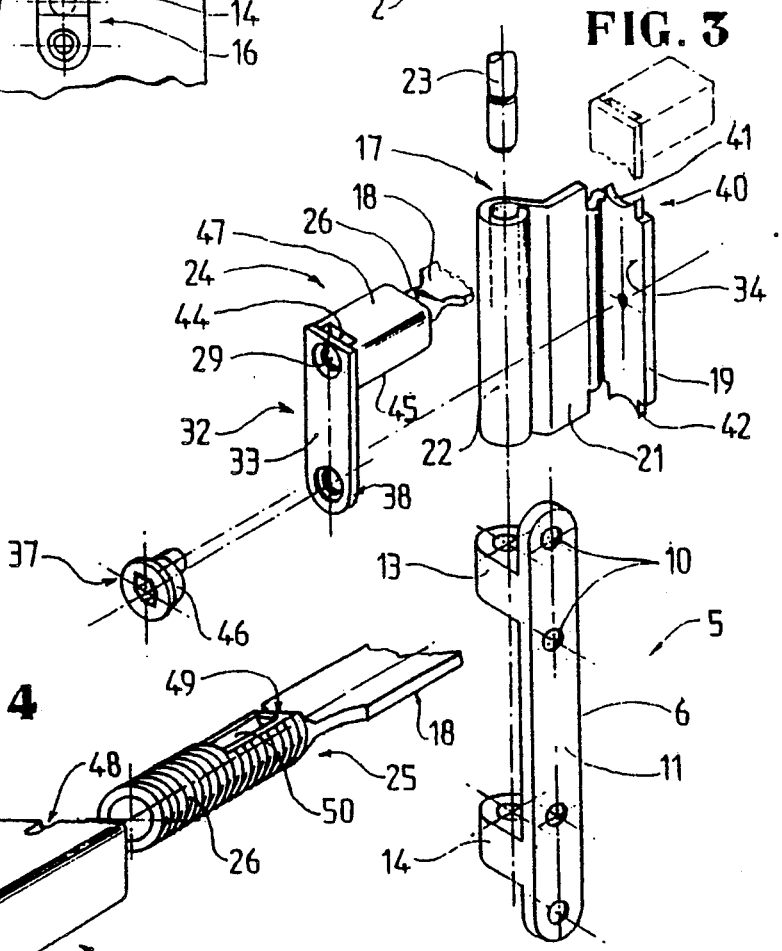
FIG. 3 is a schematic, perspective and exploded view of the folding-arm bearing shown in FIGS. 1 and 2.

This invention relates to a folding-arm bearing 1 as shown in FIGS. 1 thru 3, intended for ensuring, in particular, the upper connection between the oscillating-swinging leaf 2 and the sash-frame 3 of a door, window or the like 4.

More particularly, this folding-arm bearing 1 comprises a support 5 ensuring its connection to the sash-frame 3. That is why this support 5 has a fastening plate 6 which is inserted onto the inner face 7 of the rear stile 8 of said sash-frame 3, more particularly, close to the upper angle formed by same. Openings 10 are included in the fastening plate 6, which serve as a passageway for fastening elements, such as screws, rivets or the like.

Moreover, this fastening plate 6 can be provided on its back face 11, which is inserted onto the rear stile 8, with two studs 12 engaging into openings made in the rear stile, in order to improve the mechanical strength of the unit.

The support 5 additionally includes two knuckles 13, 14 arranged in a same vertical alignment and located substantially at the ends 15, 16 of the fastening plate 6.

The folding-arm bearing 1 also comprises a blade 17 intended for co-operating, by means of a folding-arm leg 18, with the leaf 2 of the door, window or the like. The blade 17 takes the form of a square comprising a wing 19 engaging, in closing position of the door, window or the like, into the fillister 20 of same. The other wing 21 of the blade 17 is provided, at the level of its front vertical edge, with a bushing 22. This bushing engages between both knuckles 13, 14 of the support 5. A pin 23 engaged into the bore of the knuckles 13 and 14, and into the bore of the busing 22 ensures the pivoting connection of the blade 17 onto the support 5.

The folding-arm bearing 1 is completed by a connector 24 made integral with the wing 19 of the blade 17 and co-operating with the rear end 25 of the folding-arm leg 18.

More particularly, this rear end 25 of the folding-arm leg 18 is provided with a threaded tip 26 engaging into a bore 27 (see FIG. 4) of a casing 28 forming the connector 24. The free end 29 of this threaded tip 26 furthermore protrudes on the opposite side 30 of the casing 28 and co-operates with a nut or the like so as to make the folding-arm leg 18 integral with the connector 24. Such a configuration furthermore enables the adjustment of the position of the leaf 2 with respect to its sash-frame 3 by intervening on the length of the threaded tip 26 engaged into the connector 24.

According to a feature of this invention, the folding-arm bearing 1 comprises means 32 capable of conferring some mobility, without disassembling, of the blade 17 with respect to the folding-arm leg 18, in order to ensure the reversibility of said folding-arm bearing 1, and enable its fitting, indifferently, on the right or left-hand side of the leaf of a door, window or the like. In fact, the main advantage provided by the means 32 consists in that the adaptation to a left-hand leaf of a pre-assembled folding-arm bearing with a view to a right-hand use does not require the operator to disassemble this folding-arm bearing. Only the rotation of the blade 17 with respect to the folding-arm leg 18 is needs to be carried out, and this by means of a standard tool.

According to a preferred embodiment of this invention, the means 32 are comprised of a plate 33 pivotingly and movably mounted onto the wing 19 of the blade 17, onto this plate 33 being inserted the connector 24. More particularly, the plate 33 inserts onto the rear face 34, oriented towards the rear stile 8 corresponding to the sash-frame 3, of the wing 19 so that the free end 35 of the plate 33 is protruding with respect to the upper edge 36 of the blade 17. Onto this free end 35 of the plate 22 can thus be inserted the connector 24 either by welding or by other assembling methods.

Moreover, rotating means 37 ensure the connection of the plate 33 at the level of its opposite end 38 with the wing 19 corresponding to the blade 17, and this substantially in the horizontal median plane 39 of same.

Thus, by pivoting the blade 17 by 180 degrees with respect to these rotating means 37 which connect it with the plate 33, one confers to the folding-arm bearing 1 a structure adapted to a left-hand fitting; whereas, it was initially intended for a right-hand fitting.

It should be appreciated that the means 32 enabling this mobility of the blade 17 with respect to the folding-arm leg 18, and, more particularly, with respect to the plate 33, are completed by means 40 for locking in rotation capable of ensuring the immobility of this blade 17 with respect to the folding-arm leg 18 when their arrangement, with respect to each other, corresponds to the later fitting of the folding-arm bearing 1 onto a door, window or the like.

Such locking means 40 are preferably comprised of pins 41, 42 inserted at the level of the upper edge 36 and lower edge 43 of the wing 19, one pin of which, depending on the position of the blade 17 with respect to the folding-arm leg 18, engaging into an opening 44 provided for this purpose at the level of the lower face 45 of the casing 28 forming the connector 24. Therefore, in order to enable the rotation of the plate 33 with respect to the wing 19 corresponding to the blade 17, it is, initially, convenient to release the casing 28 from either pin 41, 42. This releasing corresponding to a vertical displacement of the plate 33 and, finally, of the connector 24 with respect to the blade 17 is achieved, according to the invention, further to an action, by means of a standard tool, onto the rotating means 37 which insures the connection of plate 33 with the wing 19 of the blade 17.

These rotating means 37 are advantageously comprised of an eccentric 46 which can be operated by means of a standard tool, such as a screw-driver, a hexagon wrench or the like. This eccenter 46 should, in fact, be adapted to the most commonly used tool for the fitting and adjusting of all the components of a hinge arranged onto the leaf and the sash-frame of a door, window or the like.

In all cases and irrespective of the tool used, the rotation of this eccentric in a given direction causes the vertical displacement of the plate 33 with respect to the blade 17 which results in the disengagement, for instance, of the pin 41 from the opening 44 provided for in the connector 24. Then, it is enough to control the rotation of the plate 33 over an angle of about 180°, afterwards to act again on the eccentric 46 in order to enable the connector 24 to be positioned in front of the pin 42.

A last rotation of the eccentric 46 confers a vertical displacement to the plate 33, which ensures the engagement of the pin 32 into the opening 44 provided for in the casing 28, immobilizing thereby the folding-arm leg 18 with respect to the blade 17.

Figure 4:
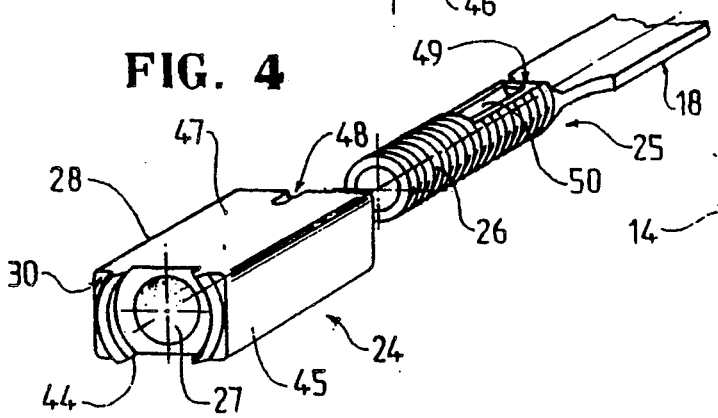
FIG. 4 is a perspective view of the pivot co-operating with the folding-arm.

As shown in FIG. 4, the opening 44, serving as a passageway for the pins 41, 42, may correspond to a boring made at the level of the rear face 30 of the casing 28, this boring ending onto the upper face 47 and onto the lower face 45 of same. In fact, such a configuration allows to confer to the connector 24 a structure substantially symmetrical with respect to a horizontal median plane enabling its fitting by rivetting onto the plate 33, indifferently in one direction or another.

It should however be appreciated that the solution of the boring, for achieving a symmetrical structure of a connector 24 provided with openings 44, is not unique and it can be envisaged to make this connector 24 either by deep drawing or by moulding, while achieving an identical design.

Furthermore, one should appreciate the peculiarity of the pins 41, 42. These are indeed slightly bent at the level of their end, so as not to form a hindrance for the passing of the threaded tip 26 of the folding-arm leg 18 through the bore 27 of the casing 28.

As can be seen in FIG. 4, the casing 28 has furthermore, at its end opposite the plate 33, a crimping 48 forming a boss capable of engaging into a slot 50 made in a flat face 49 made at the rear end 25 of the folding-arm leg 18 and, more particularly, at the height of the threaded tip 26. This feature enables to impede the folding-arm leg 18 from suddenly disengaging from its connector 24 during the adjustments of the leaf and thus by limiting this adjustment range, and the amplitude of axial movement that it is possible to confer to the folding-arm leg 18 with respect to the connector 24. Moreover, it should be appreciated that such a crimping impedes the rotation of the threaded tip 26 of this folding-arm leg 18 with respect to the connector 24, impeding thereby these components from getting loose from each other during their storage or their fitting.

Besides the main advantage of an easy adaptation of the folding-arm bearing 1 to the leaf of a right-hand or left-hand door, window or the like, this invention furthermore contributes to a better mechanical strength of this folding-arm bearing 1. The superposing of the plate 33 to the wing 19 corresponding to the blade 17 indeed confers to the unit a better torsional strength, which can be a advantage; namely, when the leaf has a certain weight.

On the other hand, this mechanical strength of the unit is not contrary to the fitting requirements of a folding-arm bearing onto the leaf and the sash-frame of a door or window. It has indeed turned out, at the level of the known folding-arm bearings, that their strength was a hindrance for this fitting and was definitely the cause of a loss of time.

In fact, this invention allows to cope with the problem related to the general rigidity of the folding-arm bearing by allowing some mobility, during the fitting, of the folding-arm leg 18 with respect to the blade 17 which it is associated with and this by simply acting on the eccentric 46. Once the fitting is completed, it is enough to act once again onto this eccentric, in order to proceed to the cancellation of this mobility.

I claim:

1. Folding-arm bearing for an oscillating-swinging leaf, comprising:

a sash-frame and a leaf having a fillister, the sash-frame having an internal face onto which is mounted a support;

a blade pivotally mounted on said support and including a wing which, in closing position of the leaf, engages into a fillister, said wing including a rear face, an upper edge and a lower edge, and a pin positioned on said upper edge and a pin positioned on said lower edge;

a plate pivotally and movably mounted on said rear face of said wing, said plate including a free end;

a folding-arm leg fastened to said free end of said plate by a connector;

said connector having a form of a casing having an opening serving for receiving one of the pins positioned on said upper edge and lower edge; and rotating means for generating a vertical movement of said plate with respect to said wing to cause disengagement of a pin from the opening in said connector.

2. The folding-arm bearing according to claim 1, wherein said rotating means include an eccentric capable of rotating.

3. The folding-arm bearing according to claim 1, wherein said blade is substantially square-shaped.

4. The folding-arm bearing according to claim 1, wherein said connector includes a first end connected to said free end of said plate.

5. The folding-arm bearing according to claim 1, wherein said pins are shaped to permit passage of a threaded tip of said folding-arm leg through a bore in said connector.

6. The folding-arm bearing according to claim 1, wherein said pins are shaped to permit passage of a threaded tip of said folding-arm leg through a bore in said connector.

7. The folding-arm bearing according to claim 1, wherein said support comprises a fastening plate.

8. The folding-arm bearing according to claim 7, wherein said fastening plate includes means forming openings for receiving fastening elements.

9. The folding-arm bearing according to claim 1, wherein said connector comprises a lower face, an upper face and a first end attached to said free end of said plate.

10. The folding-arm bearing according to claim 9, wherein said opening in said connector is on said first end.

11. The folding-arm bearing according to claim 10, wherein said opening in said connector extends to said lower face and said upper face of said connector, whereby the connector is reversible.

12. The folding-arm bearing according to claim 11, wherein said pins are shaped to permit passage of a threaded tip of said folding-arm leg through a bore in said connector.

13. The folding-arm bearing according to claim 12, wherein said connector includes a second end opposite said first end, and said second end includes crimping forming a boss.

14. The folding-arm bearing according to claim 13, wherein said folding-arm leg includes a rear end having a flat face, said flat face having a slot for receiving said boss to prevent rotation and limit axial movement of said folding-arm leg with respect to said connector.

* * * * *